US006769829B1

(12) United States Patent
Castillo et al.

(10) Patent No.: US 6,769,829 B1
(45) Date of Patent: Aug. 3, 2004

(54) DRAWABLE AND/OR TRACEABLE BINDER

(75) Inventors: Arthur G. Castillo, Chino Hills, CA (US); Norman Yamamoto, Yorba Linda, CA (US); Chitto Ron Sarkar, Brea, CA (US); Christine Kay Landis, Irvine, CA (US); Frank Yen-Jer Shih, Arcadia, CA (US); Zhisong Huang, San Dimas, CA (US)

(73) Assignee: Avery Dennison Corporation, Pasadena, CA (US)

( * ) Notice: Subject to any disclaimer, the term of this patent is extended or adjusted under 35 U.S.C. 154(b) by 144 days.

(21) Appl. No.: 09/607,996

(22) Filed: Jun. 30, 2000

(51) Int. Cl.[7] ..... B42F 13/12

(52) U.S. Cl. ..... 402/73; 281/15.1; 401/292; 402/4; 434/410

(58) Field of Search ..... 434/410; 401/292; 402/70, 73, 74–78, 4; 281/15.1, 22, 29, 31

(56) References Cited

U.S. PATENT DOCUMENTS 4,566,721 A * 1/1986 Friedman et al. ..... 281/32
4,629,349 A * 12/1986 Pitts ..... 402/74
4,673,086 A * 6/1987 Braverman et al. ..... 206/538
4,903,989 A * 2/1990 McCormick ..... 282/9 R
4,932,520 A * 6/1990 Ciarcia et al. ..... 206/232
5,029,900 A * 7/1991 Axelrod ..... 281/34
5,030,027 A * 7/1991 Bachrach et al. ..... 402/4
D343,862 S * 2/1994 Wyant ..... D19/26
5,759,701 A * 6/1998 Malhotra ..... 428/500
5,816,730 A * 10/1998 Alspaw et al. ..... 402/79
5,885,678 A * 3/1999 Malhotra ..... 428/41.8
5,961,150 A * 10/1999 Kogutt et al. ..... 281/37
6,022,111 A * 2/2000 Carls ..... 40/701
6,086,700 A * 7/2000 Valentini et al. ..... 156/235
6,099,189 A * 8/2000 Owen et al. ..... 402/79
6,124,417 A * 9/2000 Su ..... 526/318.4
6,139,210 A * 10/2000 Nelson et al. ..... 402/79
6,165,593 A * 12/2000 Brault et al. ..... 428/195
6,176,910 B1 * 1/2001 Miyazaki et al. ..... 106/31.36
6,194,077 B1 * 2/2001 Yuan et al. ..... 428/478.2
6,217,241 B1 * 4/2001 Kobayashi ..... 401/32
6,224,971 B1 * 5/2001 Tomizawa et al. ..... 428/331

OTHER PUBLICATIONS

Write On gel Binder; Rembrandt, Los Angeles California; Stock # 57250, 2000.*

* cited by examiner

*Primary Examiner*—Monica Carter
(74) *Attorney, Agent, or Firm*—Oppenheimer, Wolff & Donnelly LLP

(57) ABSTRACT

The cover of a binder is provided with a coating which is receptive to inks which are water based, solvent based or gel based, and which is substantially water-fast after the ink has dried. A coated transparent sheet may be provided on the front cover of the binder to form a pocket so that visual material inserted in the pocket may be traced, and so that the cover may be personalized. The coating may include porous pigment and a binder which includes as a component a water soluble polymer.

26 Claims, 2 Drawing Sheets

DRAWABLE AND/OR TRACEABLE BINDER

FIELD OF THE INVENTION

This invention relates to personalized binders.

Background of the Invention

It has previously been proposed to make three ring binders, for example, with transparent pockets on the cover thereof into which personal visual material may be inserted. Examples of this type of binder are shown in U.S. Pat. No. 5,857,797, granted Jan. 12, 1999; U.S. Pat. No. Des. 417, 890, granted Dec. 21, 1999; and U.S. Pat. No. Des. 421,460, granted Mar. 7, 2000.

However, in addition to personal visual material, such as photographs, or the like, it would be desirable to be able to add permanent ink images or writing onto the binder covers; and this has not been practical up to the present because the plastic binder covers will not accept all types of ink, some inks will wipe off, and high humidity or moisture will often cause the ink to run or spread.

Summary of the Invention

In accordance with one specific illustrative embodiment of the invention, a binder is provided with a transparent plastic sheet over the binder cover, in the form of a pocket into which visual material may be inserted, and the transparent sheet is provided with an ink receptive coating or layer receptive to solvent based ink, aqueous ink or gel based ink, and which is substantially water-fast following drying of the applied ink. This construction permits users to write or draw on the binder or to trace visual material which is inserted into the pocket. In addition, the user may, insert visual material into the pocket, and add written or pictorial images to the visual material, to provide a composite image on a personalized binder.

From a broader perspective, an assembly for holding papers and having front and rear covers may be provided with a coating or layer, which is receptive to aqueous, solvent based or gel inks, and which is substantially water-fast following drying of the ink. The user may then draw on the cover with any type of pen and personalize the binder with any desired printing or images. The coating may be on the inside and/or outside of either or both covers. In the case of dark fabric covered three ring binders, for example, the coating will permit ink personalization of the binders where an uncoated fabric covered binder would merely absorb the ink with little residual image.

Other objects, features and advantages of the invention will become apparent from a consideration of the associated drawings and from the following detailed description.

BRIEF DESCRIPTIONS OF THE DRAWINGS

DETAILED DESCRIPTION OF THE PREFERRED EMBODIMENTS

Figure 1:
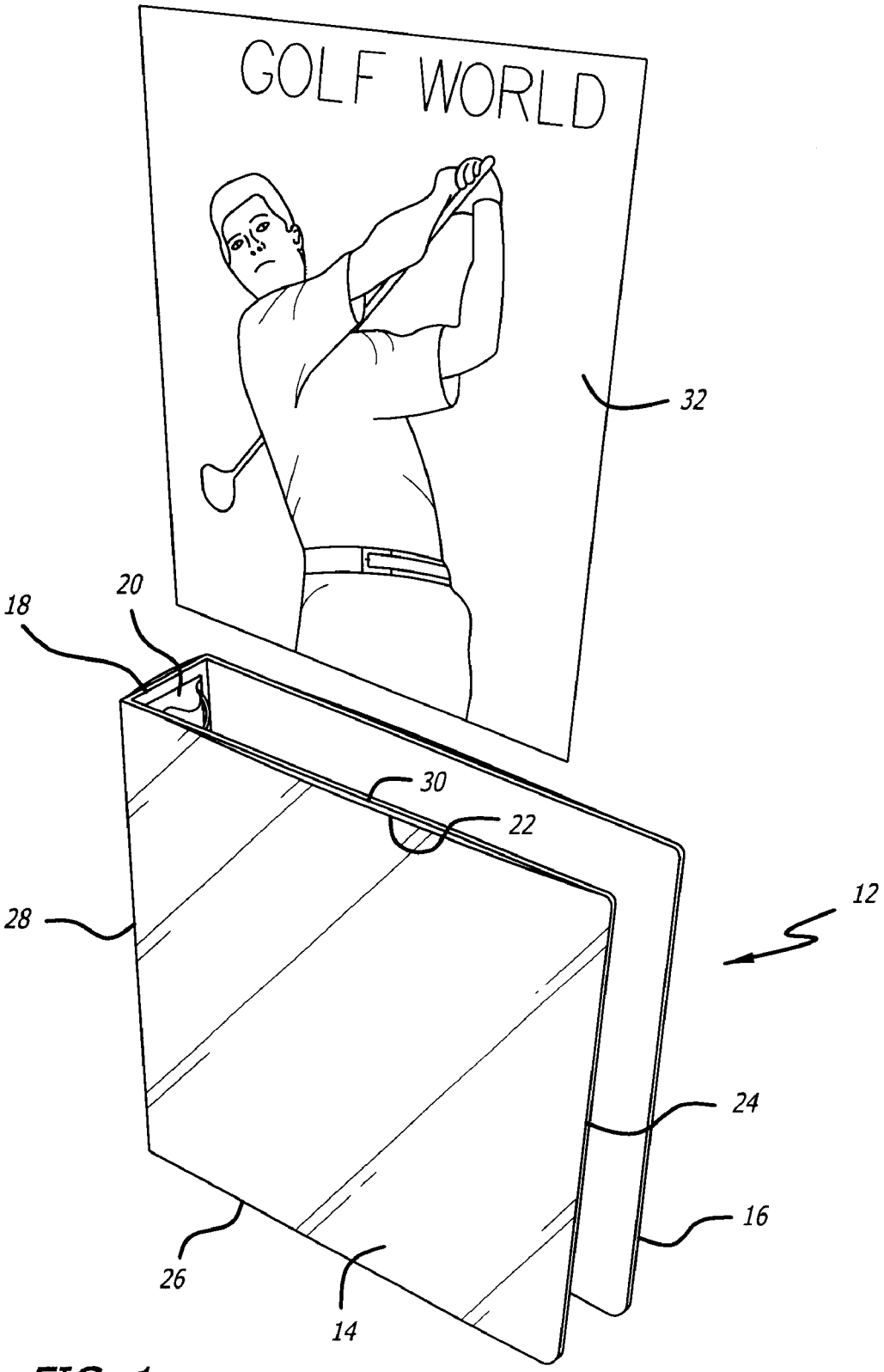
FIG. 1 shows a three ring binder with a transparent pocket on the cover thereof and a visual insert for the pocket.

Referring more particularly to the drawings, FIG. 1 shows a three ring binder 12 having a front cover 14, a rear cover 16, and a spine 18, with a ring assembly 20 mounted on the spine 18 to receive papers. Secured to the front cover 14 is a transparent or translucent plastic sheet 22, provided with an outer ink receptive coating as discussed below. The sheet 22 is secured to the front cover 14 at the right hand edge 24, at the bottom 26, and optionally at the left hand edge 28 near the spine 18. The sheet 22 is open at the top edge 30 of the front cover of the binder, to provide a pocket into which visual material 32 may be inserted.

Figure 2:
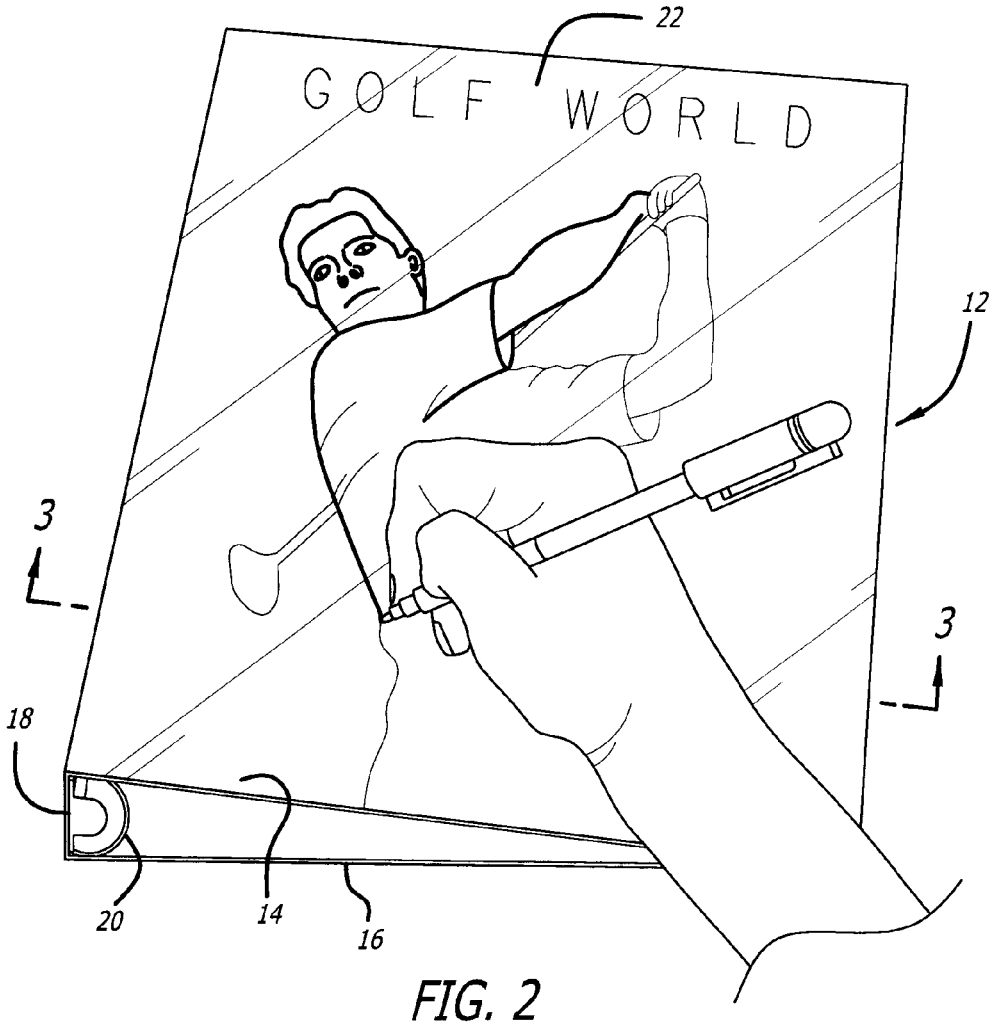
FIG. 2 shows the binder of FIG. 1 with the visual insert in the pocket, and with the user tracing a portion of the insert onto a special ink receptive layer or coating on the outer surface of the pocket.

FIG. 2 shows the visual material within the pocket formed by the plastic sheet 22, on the front cover 14 of the binder. The user is using a pen 34 to trace a portion of the image from the visual material onto a special layer or coating on sheet 22 on the cover of the binder.

Figure 3:
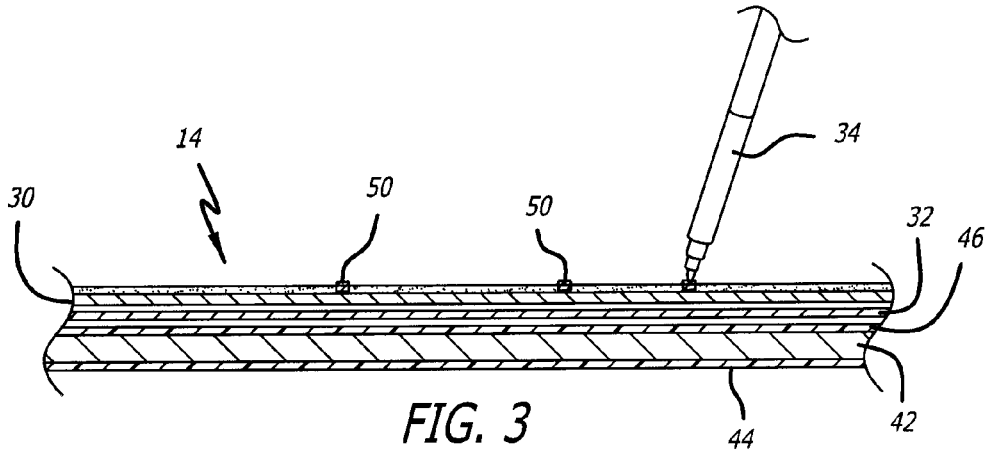
FIG. 3 is a cross-sectional view taken along line 3—3 of FIG. 2 showing the binder cover, the pocket, the insert, and the outer ink receptive layer.

FIG. 3 is a schematic cross-sectional view of a portion of the front cover 14 of the binder, taken along line 3—3 of FIG. 2. In FIG. 3, the front cover 14 includes an inner fairly stiff base member 42, covering layers 44 and 46, which may be formed of plastic or cloth, for examples, and the visual insert 32. The transparent or translucent plastic sheet 22 which forms the pocket, has an outer ink receptive coating or layer 48. Ink 50 which has just been applied to the coating is shown at several points on and in the layer 48.

Concerning the layer 48 which is receptive to aqueous, solvent based and gel based ink, the ink is also substantially water-fast once it has dried. One preferred coating is disclosed in PCT Publication Number WO 99/04981, entitled "Ink Receptive Coatings and Coated Products." This coating includes a pigment disposed in or mixed with a binder which may be an ethylene-vinyl acetate emulsion polymer and a water soluble cationic polymer. Other coatings which are receptive to all three types of ink and which are substantially water-fast are disclosed in U.S. Pat. No. 4,613,525, granted Sep. 23, 1986; European Patent Application No. 0 199 874, published Nov. 5, 1986; PCT Publication No. WO 97/01448, published Jan. 16, 1997; European Patent Specification EP 0 655 346 B1, published May 31, 1995; and PCT Publication No. WO 96/18496, published Jun. 20, 1996. These references generally relate to coatings for use with sheets used with ink jet printers, with the ink jet printers applying the water based ink to individual sheets of coated paper which may be fed one by one through the printers.

Concerning the coating, it advantageously includes a porous pigment such as silica gel, in a binder which includes as one component a water soluble polymer. It is believed that the ink is absorbed into the coating via the soluble polymer and penetrates the pores of the pigment, thus producing a clear image wherein the carrier for the ink (water or solvent) brings the ink color to penetrate the pores of the finely divided pigment of the coating.

The transparent or translucent sheet 22 may be secured at three edges to the cover 14 of the binder and may be open at the top at edge 30, for example, or adjacent to the spine. If desired, the transparent plastic material and associated ink receptive layer may be provided at the spine 18 and on the rear cover 16, as shown in FIG. 1 of the drawings. This can involve three separate pockets each open only at the top, a pocket extending over the front cover and the spine and secured to the binder at the back of the spine, or one big pocket secured to the binder only along the lower edge of the binder and at the edges of the front and rear covers away from the binder spine.

In the foregoing detailed description and in the accompanying drawings, a three ring binder was shown which had a transparent or translucent pocket on the front cover thereof. In some cases, using the preferred coating disclosed in PCT Publication No. 99/04981, the coated film may be translucent and not fully transparent. However, with the visual material in the pocket and directly adjacent to the coated film, it is clear enough to be easily traceable. Further, by using very fine pigment particles, the transparency of the coating may be increased.

It is further noted that, instead of three ring binders, the present invention is applicable to other binders for holding papers, such as binders with multiple rings or other arrangements for holding papers, including albums, folders, portfolios, multiple layer sheet protectors or report covers; and these may be provided with the additional pocket for receiving papers to be traced or displayed as discussed hereinabove for the three ring binder embodiment. Also, the coating may be applied to fabric covered binders or to plastic covered binders without a transparent cover pocket. Relative to fabric covered binders, inks applied by pen would normally be absorbed into the fabric and would not stand out prominently; however following coating, any desired image may be applied using solvent based ink, water based ink or gel pens, and the image is clear and prominent on the coated surface of the fabric binders. By coating dark binders, either cloth covered or plastic covered, images may be penned onto the coatings using pastel inks and metallic gel inks. The inside surface of binder covers may also be coated, and provided with transparent or translucent inner pockets subject to pen and ink tracing and drawing. It is also noted that the ink receptive layer may be initially embodied in a separate sheet which is laminated to the transparent or translucent sheet 30 as shown in FIGS. 1–3 of the drawings. It is further noted that the sheet 30 may be formed of vinyl, polypropylene, or any other suitable plastic. In addition, the front cover may be formed of a fairly heavy gauge plastic instead of the three layers 42, 44, and 46 as shown in FIG. 3 of the drawings. Accordingly, the present invention is not limited to the precise embodiment shown in the drawings and described in detail hereinabove.

What is claimed is:

1. A binder having a drawable/traceable cover comprising:

front and back covers hingedly coupled together and including arrangements for holding papers between said covers;

a transparent plastic sheet extending over a substantial area of and being secured to said front cover;

said transparent plastic sheet being provided with an ink receptive layer, said layer comprising a porous pigment dispersed in or mixed with a binder including a water soluble polymer, said layer being at least semi-transparent; and pocket formed between the transparent sheet and said front cover;

whereby a visual image may be inserted into said pocket and traced by writing with a pen onto said ink receptive layer.

2. A binder as defined in claim 1 wherein said transparent plastic sheet is formed of vinyl material.

3. A binder as defined in claim 1 further comprising a sheet bearing a visual image having a size slightly less than said pocket for insertion into said pocket.

4. A binder as defined in claim 1 wherein said binder includes a three ring mechanism for holding papers.

5. An assembly for holding papers or other sheet material and having a drawable/traceable cover, comprising:

front and back covers hingedly coupled together and including arrangements for holding papers between said covers;

a transparent plastic sheet extending over a substantial area of and being secured to one of said covers;

said transparent plastic sheet being provided with a layer which is receptive to water based inks, solvent based inks, and gel based inks, and which is substantially water-fast following drying of said ink; and a pocket formed between the transparent sheet and one of said covers;

whereby a visual image may be inserted into said pocket and traced by writing with a pen onto said ink receptive layer.

6. An assembly as defined in claim 5 wherein said transparent plastic sheet is formed of vinyl material.

7. An assembly as defined in claim 5 further comprising a sheet bearing a visual image having a size slightly less than said pocket for insertion into said pocket.

8. An assembly as defined in claim 5 further comprising a substantially water-fast ink image in said layer.

9. An assembly as defined in claim 5 wherein said assembly is a binder which includes a three ring mechanism for holding papers.

10. A method of forming a personalized binder comprising:

forming a binder with a plastic sheet on a cover thereof, with a pocket between said cover and said plastic sheet, said plastic sheet being provided with a layer which is receptive to water based inks, solvent based inks and gel inks, said layer also being substantially water-fast following drying of said ink;

inserting a visual image into said pocket;

tracing said at least a part of said visual image onto the transparent plastic sheet using a pen utilizing water based ink, solvent based ink, or gel ink; and drying said ink;

whereby said traced visual image is permanently fixed into said coating and is substantially water-fast.

11. A method as defined in claim 10 wherein said forming step includes coating the plastic sheet with an ink receptive coating comprising a porous pigment in a binder including a water soluble polymer; said coating and plastic sheet being at least semi-transparent to permit tracing through the sheet.

12. A binder having a drawable cover comprising:

front and back covers hingedly coupled together;

arrangements for holding papers between said covers;

an ink receptive layer on one of said covers, said layer comprising a porous pigment dispersed in or mixed with a binder including a water soluble polymer; and said layer being receptive to water based and solvent based ink;

whereby substantially water-fast personalized markings may be applied to said binder cover layer by writing with a pen onto said ink receptive layer with water or aqueous based ink.

13. A binder as defined in claim 12 wherein said binder includes a three ring mechanism for holding papers.

14. A binder as defined in claim 12 wherein a plastic sheet which is at least semi-transparent is mounted on the front cover of said binder to form a pocket, and said ink receptive layer is on said semi-transparent sheet.

15. A binder as defined in claim 12 wherein said layer includes porous pigments in a binder including as one component a water soluble polymer ink.

16. An assembly for holding paper or other sheet material comprising:

front and back covers hingedly coupled together;

arrangements for holding papers between said covers; and at least one of said covers being provided with a layer which is receptive to water based inks, solvent based inks, and gel based inks, and which is substantially water-fast following drying of said ink;

whereby substantially water fast personalized markings may be applied to the cover layer by writing with a pen onto said layer with water based ink, solvent based ink, or gel type ink.

17. An assembly as defined in claim 16 wherein said assembly is a binder which includes a three ring mechanism for holding papers.

18. An assembly as defined in claim 16 wherein a plastic sheet which is at least semi-transparent is mounted on at least one side of one of said covers of said assembly to form a pocket, and said ink receptive layer is on said semi-transparent sheet.

19. An assembly as defined in claim 16 wherein said layer includes porous pigments in a binder including as one component a water soluble polymer.

20. An assembly as defined in claim 16 wherein said assembly includes plastic sheet material which is at least semi-transparent mounted on said binder to extend over said front cover and said rear cover, and said ink receptive layer is on said sheet material.

21. An assembly as defined in claim 16 wherein at least one of said covers includes a layer of fabric material, and wherein said ink receptive layer extends over said fabric material to facilitate drawing or writing with a pen on said cover.

22. A method for personalizing an assembly for holding papers or other sheet material, said method comprising:

forming an assembly with front and back covers for holding papers or other sheets between said front and back covers;

coating at least one side of at least one of said covers with a layer which is receptive to water based inks, solvent based inks and gel inks, said layer also being substantially water fast following drying of said ink; and writing or drawing on said layer with a pen which uses water based ink, solvent based ink or gel ink, to personalize the assembly for holding sheet material.

23. A method as defined in claim 22 further comprising providing a transparent or translucent plastic sheet on one of said covers, with the ink receptive layer on said plastic sheet;

securing said transparent or translucent sheet to said cover so that it forms a pocket between said sheet and said cover;

placing visual material in said pocket; and tracing at least a portion of said visual material onto said ink receptive layer using said pen.

24. A method as defined in claim 22 wherein each of said covers has an inside surface facing the other cover, and an outside surface, and wherein said coating is applied to the outside surface of at least one of said covers.

25. A method as defined in claim 22 wherein said covers are formed using fabric material, and said ink receptive layer extends over said fabric material to facilitate drawing or writing on said fabric.

26. A method for personalizing an assembly for holding papers or other sheet material, said method comprising:

forming an assembly with front and back covers for holding papers or other sheets between said front and back covers;

coating at least one side of at least one of said covers with a layer which is receptive to water based inks, solvent based inks and gel inks, said layer also being substantially water fast following drying of said ink; and forming permanent writing or images by writing or drawing on said layer with a pen which uses water based ink, solvent based ink or gel ink, to personalize the assembly for holdings sheet material.

* * * * *